US005810996A

United States Patent [19]

Cooper

[11] Patent Number: 5,810,996

[45] Date of Patent: Sep. 22, 1998

[54] ELECTRO-OSMOTIC TRANSPORT IN WET PROCESSING OF TEXTILES

[75] Inventor: John F. Cooper, Oakland, Calif.

[73] Assignee: The Regents of The University of California, Oakland, Calif.

[21] Appl. No.: 588,038

[22] Filed: Jan. 17, 1996

[51] Int. Cl.[6] ..... D06P 5/20; D06P 7/00

[52] U.S. Cl. ..... 205/691; 205/690; 205/698; 8/444; 134/1

[58] Field of Search ..... 205/691, 690, 205/689, 693, 694, 698, 700; 8/444; 134/1

[56] References Cited

U.S. PATENT DOCUMENTS

| | | | |
|---|---|---|---|
| 894,070 | 7/1908 | Schwerin | 204/518 |
| 1,333,700 | 3/1920 | Bloom | 205/691 X |
| 1,590,602 | 6/1926 | Taylor | 205/693 X |
| 2,371,145 | 3/1945 | Brubaker | 205/691 |
| 3,642,605 | 2/1972 | Chenel et al. | 204/649 |
| 4,244,804 | 1/1981 | Moeglich | 204/629 |
| 4,376,022 | 3/1983 | Porta et al. | 204/639 X |

FOREIGN PATENT DOCUMENTS

| | | | |
|---|---|---|---|
| 1312992 | 1/1962 | France | 8/444 |

*Primary Examiner*—Kathryn L. Gorgos
*Assistant Examiner*—John S. Starsiak, Jr.
*Attorney, Agent, or Firm*—Daryl S. Grzybicki; Henry P. Sartorio

[57] ABSTRACT

Electro-osmotic (or electrokinetic) transport is used to efficiently force a solution (or water) through the interior of the fibers or yarns of textile materials for wet processing of textiles. The textile material is passed between electrodes that apply an electric field across the fabric. Used alone or in parallel with conventional hydraulic washing (forced convection), electro-osmotic transport greatly reduces the amount of water used in wet processing. The amount of water required to achieve a fixed level of rinsing of tint can be reduced, for example, to 1–5 lbs water per pound of fabric from an industry benchmark of 20 lbs water/lb fabric.

22 Claims, 3 Drawing Sheets

ELECTRO-OSMOTIC TRANSPORT IN WET PROCESSING OF TEXTILES

The United States Government has rights in this invention pursuant to Contract No. W-7405-ENG-48 between the United States Department of Energy and the University of California for the operation of Lawrence Livermore National Laboratory.

BACKGROUND OF THE INVENTION

1. Field of the Invention

The present invention relates to wet processing of textile materials by electro-osmotic or electrokinetic transport of a solution through a yarn or fabric.

2. Description of Related Art

Textiles manufacturing constitutes one of the largest industries in the industrialized world. In the United States, the textile industry is comparable in size to the automobile industry. In the manufacture of textile fabrics and yarns, there are many steps in which water is required to transport material into or out of the fabric or yarn. For example, rinsing operations are required to remove dirt and oils, caustic left over from mercerization and scouring, acids left from neutralization of trace caustic, excess dyes and tints, detergents, excess bleaches, and fixing chemicals. Water also transports materials into the fabric between the individual strands or fibers of the yarn. For example, water carries tints and dyes, chemicals imparting water repellence or fire retardation, acids for neutralization of trace caustic left from scouring or mercerizing, detergents, bleaches and color fixatives.

These transport processes typically require large amounts of water. For example, the rinsing of cotton fabric alone requires about 20 pounds of water per pound of fabric, or roughly one gallon per square yard. Since five billion pounds of cotton fabric are manufactured in the United States annually, this one product uses 12 billion gallons. Considerations of cost and environmental protection require that this water be recycled, often by filtering, precipitation, thermal reduction (boil-down), or absorption. The use and reprocessing of water is a significant cost for the textile industry, accounting for a3 to 10% of the manufacturing cost of fabric (i.e., 1.5–5 ¢/m$^2$).

It would be highly desirable to reduce to as low as possible the use of water from the current benchmark of 20 lbs water per pound of fabric. If a fabric or yarn could be treated by the displacement of a volume of water equal to the void fraction of the fabric, then water usage would fall to about one pound of water per pound of fabric.

SUMMARY OF THE INVENTION

The present invention provides an apparatus and a method for the electro-osmotic transport of solution through a textile material. The textile material is passed between two porous electrodes positioned to apply an electric field across the material in an electrochemical cell. This field drives the electro-osmotic flow of the solution through the textile material, displacing the solution within the yarns and between the fibers of the fabric. This electro-osmotic flow is assisted by pressure-driven (or hydraulic) flow of solution through the electrochemical cell.

Large amounts of water are used in wet processing of textiles, primarily due to restricted transport in the tightly wound interior of the yarn. In a preferred embodiment of this invention, an electric field of about 5 to 100 kV/m is applied transverse to the yarns or fibers by passing the fabric between two closely spaced (0.10–2 mm) electrodes having a potential difference of about 2 to 25 V. The electric field causes the movement of water in a thin layer immediately adjacent to the yarn-water interface, which displaces the water within the yarns. The force applied to the water by electro-osmosis is independent of porosity and depends only on the projected surface area parallel to the field.

If a pressure-driven flow is passed through the fabric in parallel with and at the same rate as the electro-osmotic driven flow, then a volume of water contained within the voids of the fabric is uniformly displaced from the interior of the fabric and constituent yarns, and a complete rinsing is done with roughly one pound of water per pound of fabric. Annually, this reduction in wash water can save 11 billion gallons of water and the thermal processing of the water, at cost savings of over one hundred million dollars.

DETAILED DESCRIPTION OF THE INVENTION

This invention is a method and an electrochemical cell for electro-osmotic transport of solution through yarns and fabrics for wet processing of textile materials. An electric field is applied across the fabric to produce electro-osmotic movement of solution within the textile yarns and adjacent to the fibers to displace the liquid within the fabric. This electro-osmotic flow may be accompanied by a simultaneous and parallel pressure-driven or "hydraulic" flow, which moves the solution between the yarns in the fabric. Typically, the rate of solution displacement in spaces between the yarns should match the rate of transport of solution within the yarns.

Wet processes used in the manufacture of textiles involve the transport of liquid-borne materials into or out of the interior of the fabric or yarns (i.e., bundles of fibers). These processes include rinsing or washing for sizing or removal of dirt, oils, caustic solution from mercerization and scouring, acids from neutralization of trace caustic, excess dyes and tints, detergents, excess bleaches, and fixing chemicals. The solution moving through the fabric may also be used to carry tints and dyes, chemicals imparting water repellence or fire retardation, acids for neutralization of trace caustic left from scouring or mercerizing, detergents, bleaches, and color fixatives. The textile materials being treated include materials such as cotton, polyester, blended fabrics, wool fabric, and other fabrics consisting of woven or non-woven yarns or fibers of natural or man-made origin.

Figure 1:
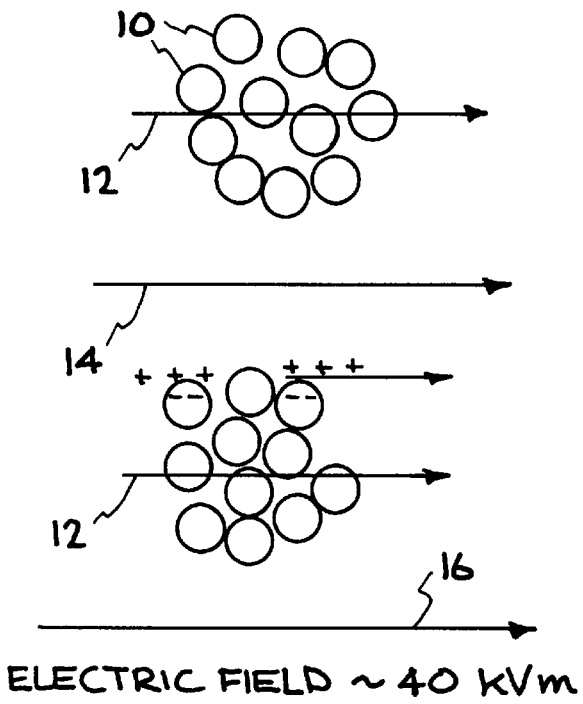
FIG. 1 shows the concept of parallel electro-osmotic and pressure-driven transport within a fabric.

FIG. 1 shows the concept of parallel electro-osmotic transport and hydraulic transport within a fabric. Large volumes of a solution (or water) are normally required to rinse fabrics to overcome the slow rate of exchange between the interior of the yarns and the spaces between the yarns. The closely packed, parallel fibers 10 that constitute a yarn may be tightly wound, restricting the flow of liquid into or out of the interior of the yarn. Transport of dissolved material from the interior of the yarn into the open weave is controlled by slow molecular diffusion. In the present invention, the rinsing process is improved and accelerated by electro-osmotic transport 12 operating within the yarns with a parallel hydraulic transport 14 in spaces between the yarns.

Electro-osmotic transport results from the interaction of an external electric field 16 with the electrical charges that accumulate in the electrolyte near the surface of the fibers in the textile material. In general, any dielectric surface will tend to bear a net charge, either from ionization of the surface chemical groups or from preferential adsorption of charged ions. Within the electrolyte adjacent to the surface, ions of opposite charge will tend to accumulate. Because of thermal energy, these compensating ions will tend to be distributed in the electrolyte, extending into the electrolyte about 1–10 nm. This region of the electrolyte is called the "diffuse double layer". This distance roughly marks the extent to which the negative surface charge influences charge distribution, overcoming the random motion of ions due to thermal energy. In most cases, cotton and mixed fiber fabrics will show a positive electro-osmotic coefficient, indicating that the diffuse double layer has a net positive charge. With some animal fibers and acidic electrolytes, the situation may be reversed: negative charges may accumulate in the diffuse double layer, leading to a negative electro-osmotic coefficient.

Cotton, for example, is primarily cellulose (a polysaccharide), and its surface has electron-rich hydroxyl groups and carboxylate groups. The surface of the cellulose is normally hydrated, and the water molecules are held by hydrogen bonding. The application of an external electric field to a cellulose-electrolyte system will cause the free positive charge that naturally accumulates in the diffuse part of the electric double layer to drift in the direction of the field, carrying with it the water of hydration and a larger amount of water by viscous drag. The movement of solution by electro-osmosis is independent of pore fraction and depends only on the aggregate surface area of the pores. The solution is readily moved by the electric field in regions of the yarn that are inaccessible to pressure-driven flow (forced convection). The applied field 16 may be parallel to, or in the opposite direction of, the electro-osmotic and pressure-driven flows, depending on the sign of the electro-osmotic coefficient.

This process is most useful if the rinse solution is reasonably low in conductivity (e.g., about that of common tap water). The conductivity should be below about 0.1 $ohm^{-1}cm^{-1}$ (i.e., with resistivity greater than about 1000 ohm-m), and is typically below 0.01 $ohm^{-1}cm^{-1}$. Otherwise, the flow of electrical current will waste electrical energy and heat the fabric. Even if the fabric is wetted with highly conductive electrolytes (such as caustic from scouring or mercerization), the process can still be economically and technically feasible if the conductivity of the displacing wash water is low.

Figure 2:
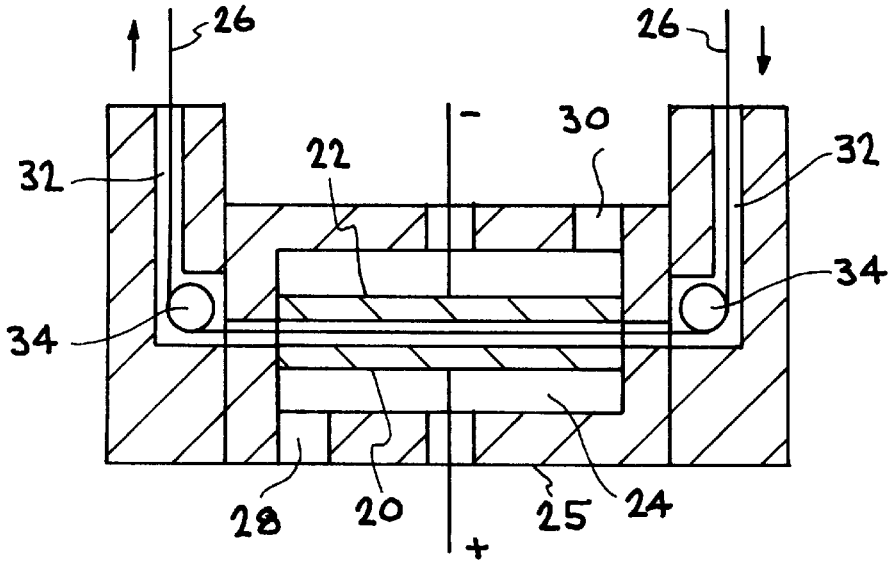
FIG. 2 shows an embodiment of an electrochemical cell according to this invention.

FIG. 2 shows an embodiment of an electrochemical cell according to the present invention supporting parallel electro-osmotic and hydraulic transport of water. An anode 20 and cathode 22 are positioned in the cell cavity 24 within the cell housing 25, which in operation contains a solution. The electrodes are porous, having pores or channels that allow flow-through of the cell solution. The electrodes in this embodiment are plane parallel or semi-planar; the electric field and current flow is from the anode 20 to the cathode 22. The applied electrical field is typically between about 5–100 kV/m. The difference in potential between the electrodes is about 1–50 V, or preferably 1–25 V.

The cell has means for moving the textile material 26 to be processed into and through the cell, between and substantially parallel to the electrodes. The fabric movement is shown by arrows, and the rate of movement is typically between 1–100 m/min. The solution flows through and substantially perpendicular to the electrodes 20,22 and the fabric 26. The solution is supplied at a uniform rate to the electrochemical cell through an inlet 28 or inlet manifold, and after passing through the electrodes 20,22 and fabric 26, exits the cell at an outlet 30 or outlet manifold. The solution is substantially retained within the cell by the use of two wells 32, into which the fabric 26 is diverted by a pair of rollers 34. Squeegees may be used, in place of or in addition to the wells, to retain the solution in the cell.

The surface of either the anode or cathode may comprise a porous, water-permeable, insulating layer, which prevents direct electrical contact between the anode and the cathode wherever the two electrodes are not separated by the fabric (such as the lateral edges). One or more diffusers, made of a porous, water-permeable membrane (such as woven fabric, or a porous ceramic, glass, or plastic frit), moderates the flow of solution at the inlet 28. The diffusers control water transport uniformity over the broad surface of the fabric by introducing a pressure drop into the hydraulic flow stream that is larger than the pressure drop through the fabric.

The electrodes should be spaced as closely as possible without causing undue friction between electrodes and fabric. The closer the spacing, the greater the applied field and the lower the ohmic losses associated with the electrolytic current. The electrodes are typically spaced about 0.10–2 mm apart, preferably 0.25–1 mm, or about 1–5 times the fabric thickness. The close spacing of electrodes also minimizes the horizontal mixing of electrolyte carried by the moving fabric. Because of the relative movement of fabric and electrodes and the close spacing of the electrodes, there is an unavoidable friction, and the electrodes should be as smooth as possible. Polished electrodes of 0.5 mm nickel plate, perforated with 0.5 mm holes, have been used effectively. The friction was found acceptable at 10 m/min for a gap equal to three times the fabric thickness.

Figure 3:
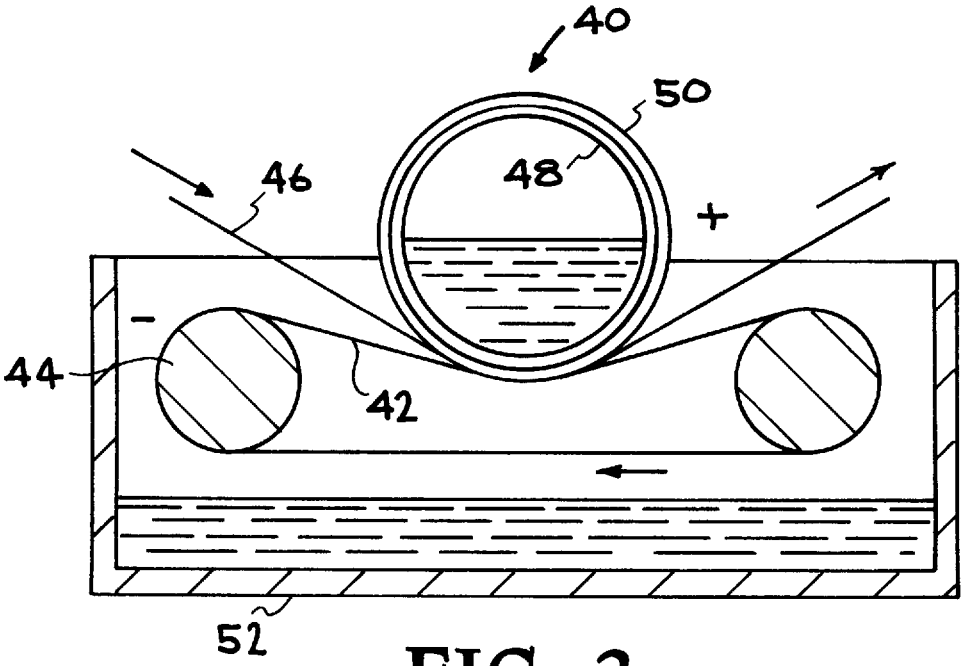
FIG. 3 shows an alternative embodiment of the present invention in which the electrodes comprise a drum and conforming belt.

FIG. 3 shows an electrochemical cell with electrodes in the form of a drum 40 and a conforming belt 42 on rollers 44 moving over the drum 40. The electric field is applied across a fabric 46 moving with near zero friction by passing the fabric 46 over a perforated drum 40 moving at the same rate, while the counter electrode 42 moves and conforms to the shape of the drum 40 to provide an extended electrode surface. If the drum 40 is the anode and the belt 42 is the cathode, then the hydraulic flow of the solution (parallel with the field-driven flow) is typically from the interior of the drum 40, through a diffuser layer 48, and then through a porous drum surface 50. The solution is carried into the space between the electrodes 40,42 in a position above the fabric 46, and is allowed to flow downwards by gravitational and centrifugal forces through the fabric, where it falls from the belt 42 and collects at the base 52 of the cell for removal. A porous electrically insulating layer (not shown) may be placed on the surface of the belt 42 or the drum 40 to separate the electrodes from the fabric 46.

Figure 4:
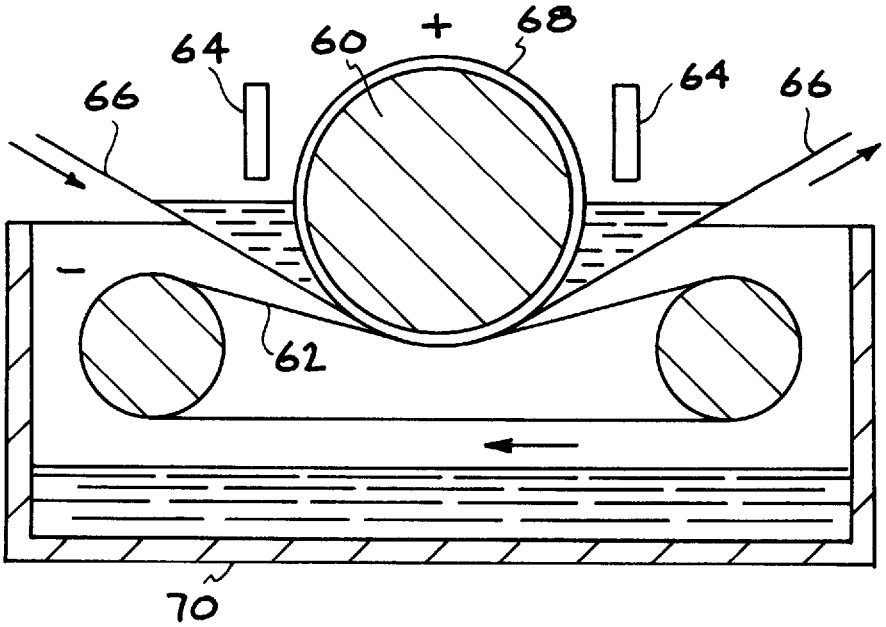
FIG. 4 shows an alternative design to the embodiment shown in FIG. 3 with water jets upstream and downstream of the textile material being processed.

FIG. 4 shows an electrochemical cell with a rotating drum 60 and conforming belt 62 assembly, similar to the cell design in FIG. 3. In the present design, however, the solution is ejected from nozzles 64 across the full width of the fabric 66 and is entrained by the fabric 66 and a very porous layer 68 (conducting or insulating) on the impervious surface of the drum 60. The solution is carried into the space between the electrodes 60,62 in a position above the fabric 66, and is allowed to flow downwards by gravitational and centrifugal forces through the fabric 66, where it falls from the belt 62 and collects at the base 70 of the cell for removal.

Again, an insulating layer (not shown) may be placed on the surface of the belt 62 or the drum 60 to separate the electrodes from the fabric 66. The advantage of this configuration over that of FIG. 3 is the ability to direct the two streams of water either co-current (nozzle at material feed) or counter-current (exit). This improves efficiency of rinsing, but relies on the head developed by the two trough-shaped spaces bounded by the drum 60 and the fabric 66, and requires a very porous layer 68 that allows water to flow from the troughs to the lowest part of the drum 60.

A second perforated belt may be used instead of a drum in cases where space is limited. The textile material moves between the belts at the same rate as the belts, achieving near zero friction and allowing minimum electrode spacing over a long contact area.

Theory of Electro-osmotic Transport in Fabrics

The relation between the electric field (F) and the internal water velocity (v) in a porous body defines the electro-osmotic transport coefficient, $K_{eo}$ (units, $m^2/Vs$):

$$v=K_{eo}F.$$

In textiles processing according to this invention, the pair of electrodes on either side of the fabric is charged to impose an electric field normal to the fabric. Since the external flow of water is what is measured experimentally and in practical applications, the above equation is recast in terms of an external volumetric flow rate (G) for the transverse field (F):

$$G=eAK_{eo}F,$$

where A is the area of the fabric and e is the porosity. Table I provides typical values of $K_{eo}$ for cotton, cotton-polyester blend (50% ), and polyester materials.

TABLE I

Typical values of the electro-osmotic transport coefficient for various fabrics at ambient temperature

| Fabric | $K_{eo}$, $m^2/Vs$ | Solution | Field, kV/m |
|---|---|---|---|
| Cotton (industry-standard twill) | 1.7–1.9 E-8 | 0.5% $Na_2CO_3$ | 1.1–1.4 |
| Cotton/polyester blend (50%) | 2–3 E-8 | 0.5% $Na_2CO_3$ | 1.4 |
| Polyester | 2.2–3.3 E-8 | 0.5% $Na_2CO_3$ | 2–2.7 |

An experimental system was used to determine electro-osmotic transport coefficients and measure the enhancement of rinsing efficiency due to parallel electro-osmotic and hydraulic flow. The cell, as shown in FIG. 2, has a pair of plane parallel electrodes configured to apply a field transverse to he moving fabric. The electrodes are perforated nickel, ~0.5–1 mm thick, having a hexagonal array of 1 mm holes spaced ~3 mm apart. The electrodes are separated by a distance of 1 mm, while the fabric (0.3 mm thick) is pulled between the electrodes by motor driven rollers. Each electrode is split into two equal halves along the line of travel; the halves are insulated such that either half can be activated electrically. By electrically activating only one pair of electrodes (e.g., those on the left hand side of the cell), a field can be applied to only one half of the total cell, while the other half supports an identical hydraulic flow and serves as an internal experimental control.

The hydraulic flow of water is counter-current to the fabric being rinsed, to optimize efficiency. The fabric enters and leaves from wells supporting an hydraulic head equal to the pressure drop across the fabric caused by the hydraulic flow. The test fabric (typically an industry standard cotton twill), is saturated with a tint (Milliken & Company, Versatint Red II) just before entering the cell. Using digital video recording, the intensity of tint on the fabric is measured upon entering the cell and compared with the intensities of the tint on the exiting fabric for the field-driven and hydraulic flow side, and on the hydraulic-only side (the control).

Figure 5:
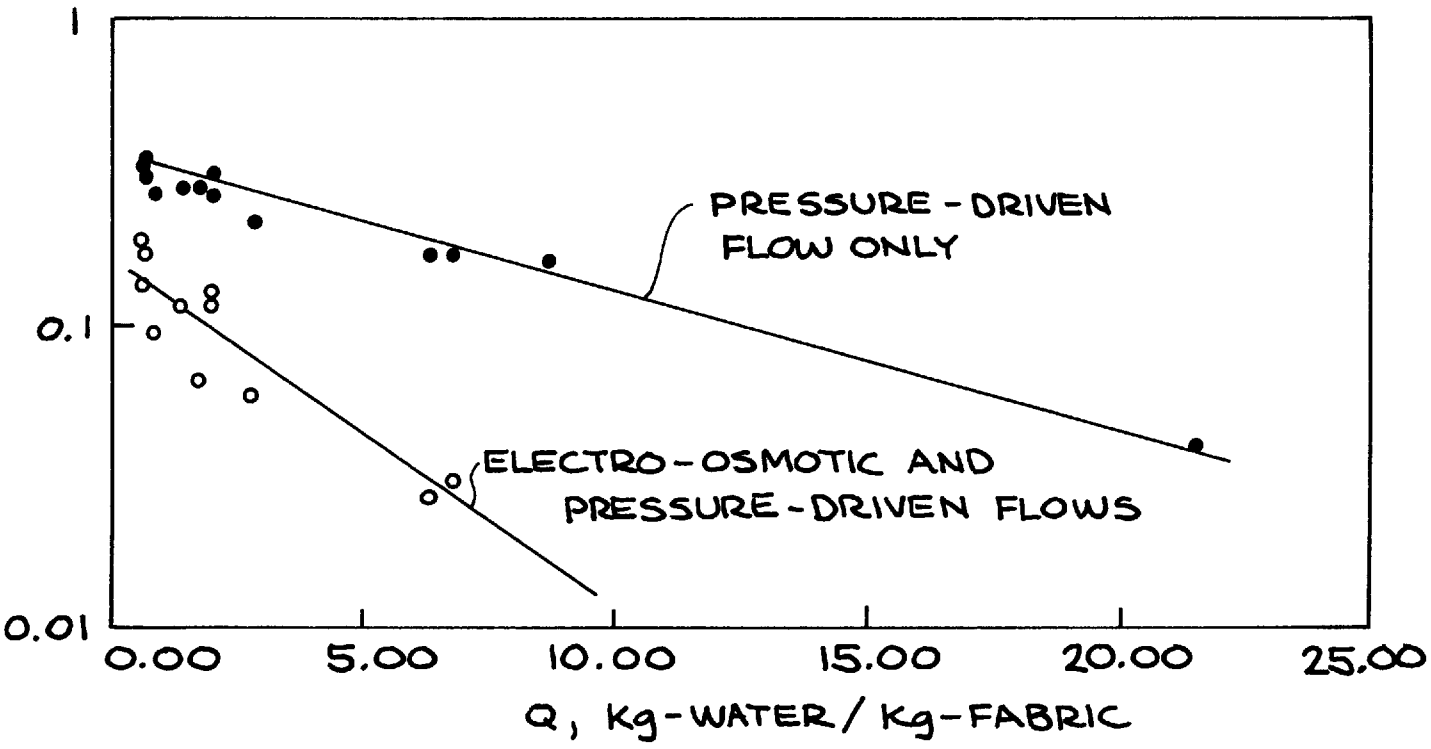
FIG. 5 shows the enhancement of rinsing of tints by application of an electric field in parallel with pressure-driven flow, in comparison with pressure-driven flow only.

In FIG. 5, the attenuation of the tint signal (exit intensity divided by entrance intensity) is plotted against the amount of water allowed to flow through the fabric, Q, measured in dimensionless units of kilograms water per kilogram of fabric. The upper set of data points is for the field-free half of the cell. The lower set of data points is for the application of 25 V across the electrodes separated by 0.75 mm in parallel with hydraulic flow identical to that of the field free case. The average field strength in the cell is 33 kV/m.

Rinsing efficiencies of 95% (attenuation) are achieved with Q=5 for parallel hydraulic and electro-osmotic transport, while the hydraulic only case requires about five times as much water. Assuming an electro-osmotic transport coefficient of 1.5 E-8 $m^2/Vs$, then the velocity of the water flow being driven by the field (measured external to the fabric of 50% porosity) is about 250 micrometers per second— about the same as the hydraulic flow at Q=1. FIG. 5 shows that a field can be applied transverse to a moving fabric to cause a transverse flow of water in parallel with a hydraulic flow in order to enhance the rate and the efficiency of a rinsing operation.

The water being transported by electro-osmotic forces must contain dissolved ions, as evidenced by having a finite electrical conductivity greater than about 0.00001 $ohm^{-1}cm^{-1}$, and preferably between about 0.0001 and 0.01 $ohm^{-1}cm^{-1}$. Normally, tap water has a sufficient ionic concentration of salts to support electro-osmotic transport. If the conductivity of the water is too low, then a benign "supporting electrolyte" can be added. For example, sodium sulfate can be added in sufficient quantity to make a 0.01 M solution, having an electrical conductivity of 0.0015 $ohm^{-1}cm^{-1}$. Also, many materials used in wet processing (e.g., dyes, acids) may contain sufficient ions for electro-osmotic transport.

Balancing Hydraulic and Electro-osmotic Flow to Minimize Water Use

To predict the conditions for minimizing water use, the important quantities should be expressed in generalized, dimensionless units. The water usage factor, Q, is defined as the ratio of the weight of water used to achieve a desired level of rinsing to the weight of the fabric being rinsed. The current industrial benchmark is Q=20 (lbs water per lb fabric), while some vacuum displacement, equipment achieves Q as low as 5. Q is given by:

$$Q=uL\rho/V_f\sigma,$$

where u is the (external) water velocity normal to the fabric (pressure-driven), L is the length of the electrode, ρ is the density of water, σ is the weight of the dry fabric per unit area, and $V_f$ is the linear velocity of the fabric moving through the cell. The ratio $L/V_f$ is simply the residence time ($\tau_{res}$) of the fabric within the cell:

$$\tau_{res}=L/V_f.$$

To use electro-osmotic transport effectively, the residence time must allow at least one displacement (and perhaps as many as n displacements) of water through the full thickness of the fabric (s) in accordance with the relationship $v=K_{eo}F$.:

$$\tau_{res}=ns/K_{eo}F).$$

Under ideal conditions, the velocity of electro-osmotic flow within the yarns will be comparable to the velocity of pressure-driven flow (hydraulic flow) in the open weave, as this will allow a simultaneous displacement of all water from the fabric. This equivalence is expressed by:

$$u/e=K_{eo}F,$$

where the void fraction of the space between the yarns is given by e. Finally, the ratio of pressure-driven flow to electro-osmotic flow may be enhanced by the factor $R_{he}$ to compensate for inevitable non-uniformity in the hydraulic flow distribution. The previous equation becomes $$u=eR_{he}K_{eo}F.$$

The final expression for Q independent of the field, velocity, and transport coefficient becomes $$Q=eR_{he}nsρ/σ.$$

For industry standard cotton twill and an idealized case of e~0.5, $R_{he}$=n=1, s=0.0004 m (17 mils), and water and fabric1000 kg/m$^3$ 0.234 kg/m$^2$, respectively, Q is 1.15. A limiting case of Q~1 is expected from the estimate that fabric void fraction is about one-half and the weight of dense cellulose and water are comparable.

Since electric current (I) is passed through the cell, it is important to consider the electrical energy consumption and estimate the cost input of this energy relative to a benchmark producers cost of about \$0.50/m$^2$. The energy dissipated by the cell per unit area of cloth (A) at voltage V and with a gap equal to fabric thickness is given by E:

$$E=(VI/A)\tau_{res}.$$

The current (I) can be estimated for a known rinse water resistivity ($\rho_{el}$) and fabric thickness (s) from the equation:

$$I=VAe/\rho_{el}s.$$

For an effective rinse water resistivity ($\rho_{el}$) taken to be uniform throughout the fabric of void fraction e, the energy dissipated per unit area is:

$$E=(eV^2/s\rho_{el})\tau_{res}.$$

For example, if the voltage drop is 25 V, s=0.4 mm (17 mils), $\tau_{res}$=1s,n=3, and the conductivity of the rinse water is 10 ohm-m (tap water), then the electrical energy use is 0.02 kWh/m$^2$, which is about \$0.001/m$^2$ (at \$0.06/kWh).

The electrical resistivity of the rinse water, not that of the water in the pores of the fabric, will determine the overall resistance of the cell and thus the energy use. Still, it is important to note that this process should not be used on highly conductive fabric, such as fabric directly emerging from a mercerization range, as the current flow would be prohibitive. Rather, a pre-rinse is desirable to exclude most of the high conductivity material from the fabric.

Table 11 compares some of the important parameters for various fabric types, given different assumptions of n, $R_{he}$, and $V_f$.

TABLE II

Parameters for electro-osmotic enhancement of hydraulic rinsing

| Fabric | n | $R_{he}$ | $V_f$ m/min | L m | τres s | u mm/s | ΔH mm | Q | E Wh/m$^2$ | Cost ¢/m$^2$ |
|---|---|---|---|---|---|---|---|---|---|---|
| Cotton[a] | 1 | 2 | 10 | 0.13 | 0.83 | 0.52 | 20 | 1.85 | 4.2 | 0.025 |
| | 2 | 2 | 10 | 0.25 | 1.66 | 0.52 | 20 | 3.71 | 8.3 | 0.050 |
| | 1 | 2 | 30 | 0.38 | 0.83 | 0.52 | 20 | 1.85 | 4.2 | 0.025 |
| | 2 | 2 | 30 | 0.76 | 1.66 | 0.52 | 20 | 3.71 | 8.3 | 0.050 |
| | 2 | 2 | 100 | 2.53 | 1.66 | 0.52 | 20 | 3.71 | 8.3 | 0.050 |
| | 2 | 4 | 100 | 2.53 | 1.67 | 1.04 | 40 | 7.4 | 8.3 | 0.050 |
| Cotton/ polyester[b] | 1 | 2 | 10 | 0.09 | 0.29 | 0.89 | 3.2 | 1.85 | 2.4 | 0.015 |
| | 2 | 2 | 10 | 0.09 | 0.57 | 0.89 | 3.2 | 3.71 | 4.9 | 0.029 |
| | 1 | 2 | 30 | 0.13 | 0.29 | 0.89 | 3.2 | 1.85 | 2.5 | 0.015 |
| | 2 | 2 | 30 | 0.26 | 0.57 | 0.89 | 3.2 | 3.71 | 4.9 | 0.029 |
| | 2 | 2 | 100 | 0.87 | 0.57 | 0.89 | 3.2 | 3.71 | 4.9 | 0.029 |
| | 2 | 4 | 100 | 0.87 | 0.57 | 1.77 | 6.1 | 7.41 | 4.9 | 0.029 |

[a]Cotton: s = 0.43 mm (17 mil); $\sigma/\rho$ = 2.33 $10^{-4}$ m; $K_{eo}$ = 1.8 $10^{-8}$ m$^2$/Vs
[b]Cotton/50% polyester: s = 0.25 mm; $\sigma/\rho$ = 1.37 $10^{-4}$ m; $K_{eo}$ = 2.5 $10^{-8}$ m$^2$/Vs
Fixed parameters: cell voltage = 12.5 V; void fraction of weave = 0.50; cost of electricity = 6¢/kWh; rinse water electrical resistivity = 10 ohm-m (1000 ohm-cm)

The optimum use of water requires a very uniform distribution of hydraulic flow across the fabric. This factor becomes progressively more important as the lower limit of Q is approached, or as the velocity of the fabric increases. The parallel plate configuration of the present invention is useful at low fabric velocities (1–15 m/min). At very high velocities (30–100 m/min), water will be dragged along by viscous forces on both surfaces of the fabric causing a mixing of the clean water over the surface and a smearing of the of the clean water over the surface and a smearing of the water passing through the fabric over the downstream surface (opposite the cathode).

The drum embodiment of the invention is favored for providing high degrees of uniformity in water flow at high fabric velocities (30–100 m/min) because there is no free water between fabric surfaces and the electrodes. Moreover, since the fabric is not dragged across the surface of the electrodes but pressed between them, the interelectrode gap is the same as the compressed width of the fabric. This insures that a maximum useful field strength will be achieved with a minimum cell voltage and power dissipation.

The hydraulic pressure drop through a fabric will tend to equalize the flow distribution through it. If the porous drum and porous belt have high permeabilities to water flow, then the fabric itself will tend to be the controlling resistance in the hydraulic circuit. Since the linear flow velocities in Table II tend to be very low (i.e., a few mm/s), one must determine what hydraulic head is necessary to achieve such flows, and how such small pressure drops can be achieved in a practical system.

According to one statement of Darcy's Law, the linear flow velocity (u) of a liquid of viscosity $\mu$ through a porous body of pore fraction e and thickness s is proportional to the pressure drop:

$$u=(eK_D/\mu)\Delta P/s.$$

Expressing the pressure drop ($\Delta$P) as a hydraulic head of water $\Delta$H, the equation becomes $$u=K_H\Delta H,$$

where $K_H$=(e $K_D\rho g/s\mu$),g is the acceleration due to gravity, $\rho$ is the water density, and $K_D$ is Darcy's Law permeability. Table III gives typical Darcy's law coefficients, $K_D$ with $K_H$, for the simplified case of uniform pressure drop through the thickness of the fabric.

TABLE III

Permeability constants for typical fabric samples

| Fabric | Thickness, mm | $10^{12}$ $K_D$, $m^2$ | $K_H$, $s^{-1}$ |
|---|---|---|---|
| Cotton, industry standard twill | 0.43 | 1.1 | 0.026 |
| Cotton-50% polyester blend | 0.25 | 7.5 | 0.28 |
| Polyester | 0.25 | 16 | 0.62 |

The hydraulic heads are typically quite low to force water through cotton, polyester, and blends of the kind taken as standards for use in developing Table II and Table III. Clearly, if hydraulic head is to be used to control flow rate and flow uniformity, then a diffusion of less permeability than that of typical fabrics must be placed in series with the fabric being rinsed.

The foregoing description of preferred embodiments of the invention is presented for purposes of illustration and description and is not intended to be exhaustive or to limit the invention to the precise form disclosed. Many modifications and variations are possible in light of the above teaching.

I claim:

1. An electrochemical cell for electro-osmotically transporting a solution through a textile material for wet processing, comprising:

means for driving an electro-osmotic flow of the solution through the textile material by applying an electric field transverse to the textile material, comprising a pair of electrodes comprising an anode and a cathode situated in the cell, wherein the electrodes are porous to allow the solution to pass through the electrodes, and are spaced to allow the textile material to pass between the electrodes, and wherein the electrodes are positioned for applying the electric field transverse to the textile material to drive the electro-osmotic flow of the solution through the textile material;

means for moving the textile material between the electrodes;

a cell housing including an inlet and an outlet; and means for producing a pressure-driven flow of the solution through the cell parallel to the electric field by passing the solution into the cell through the inlet, then through a first electrode of the pair of electrodes, through the textile material, through a second electrode, and then out of the cell through the outlet.

2. An electrochemical cell as recited in claim 1, wherein the first electrode is the anode, and the second electrode is the cathode.

3. An electrochemical cell as recited in claim 1, wherein the first electrode is the cathode, and the second electrode is the anode.

4. An electrochemical cell as recited in claim 1, wherein the electrodes are separated by a distance of about 0.10 mm to 2 mm.

5. An electrochemical cell as recited in claim 1, wherein the electrodes are separated by a distance of about 1 to 5 times the thickness of the wet textile material.

6. An electrochemical cell as recited in claim 1, wherein the electrodes are stationary plane parallel electrodes.

7. An electrochemical cell as recited in claim 1, wherein the electrodes are rotating perforated belts, wherein a first belt moves over a second belt at substantially the same surface velocity as the second belt, whereby the textile material moves between the belts.

8. An electrochemical cell as recited in claim 1, wherein one electrode is a rotating perforated drum and the other electrode is a perforated belt moving over the drum at substantially the same surface velocity as the drum, whereby the textile material moves between the belt and drum.

9. An electrochemical cell as recited in claim 8, wherein the anode comprises the drum, and the solution flows from the interior of the anode drum through the textile material to the cathode.

10. An electrochemical cell as recited in claim 1, wherein at least one electrode is coated with a porous material that is electrically-insulating.

11. An electrochemical cell as recited in claim 1, wherein one electrode is a rotating unperforated drum coated with a porous material and the other electrode is a belt moving over the drum at substantially the same surface velocity as the drum, whereby the textile material moves between the belt and drum parallel to the drum and belt and at substantially the same velocity.

12. An electrochemical cell as recited in claim 11, further comprising means for introducing the solution between the textile material and the porous coating.

13. A method for electro-osmotically transporting a solution through a textile material in an electrochemical cell for wet processing, comprising:

moving the textile material between a pair of electrodes, comprising an anode and a cathode, in a cell containing the solution;

applying an electric field transverse to the textile material to drive electro-osmotic flow of the solution through the textile material; and passing a pressure-driven flow of solution through the textile material parallel to the electric field, whereby the solution in the textile material is displaced from the interior of the textile material.

14. A method as recited in claim 13, further comprising passing the pressure-driven flow through the textile material at about the same rate as the electro-osmotic flow.

15. A method as recited in claim 13, wherein the pressure-driven flow is in the opposite direction of the electric field.

16. A method as recited in claim 13, wherein the pressure-driven flow is in the same direction of the electric field.

17. A method as recited in claim 13, further comprising removing substances from the textile material using the solution that passes through the textile material.

18. A method as recited in claim 13, further comprising imparting new substances to the textile material using the solution that passes through the textile material.

19. A method as recited in claim 13, further comprising applying the electric field at about 5 to 100 kV/m.

20. A method as recited in claim 13, wherein the electrodes have a potential difference of about 1 to 50V.

21. A method as recited in claim 13, wherein the electrodes have a potential difference of about 2 to 25V.

22. A method as recited in claim 13, wherein the solution has an electrical conductivity below about 0.1 $ohm^{-1}cm^{-1}$ and greater than about 0.00001 $ohm^{-1}$ $cm^{-1}$.

* * * * *